US009685748B2

(12) United States Patent
Wang et al.

(10) Patent No.: US 9,685,748 B2
(45) Date of Patent: Jun. 20, 2017

(54) ADAPTER AND ELECTRICAL TERMINAL THEREOF

(71) Applicant: Cheng Uei Precision Industry Co., Ltd., New Taipei (TW)

(72) Inventors: Bin Wang, Dong-Guan (CN); Yong-Gang Mao, Dong-Guan (CN); Xue-Wen Lu, Dong-Guan (CN)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/096,007

(22) Filed: Apr. 11, 2016

(65) Prior Publication Data

US 2017/0133806 A1 May 11, 2017

(30) Foreign Application Priority Data

Nov. 7, 2015 (CN) ..... 2015 2 0892123 U

(51) Int. Cl.

| | |
|---|---|
| ***H01R 31/06*** | (2006.01) |
| ***H01R 24/64*** | (2011.01) |
| ***H01R 24/28*** | (2011.01) |
| ***H01R 13/6581*** | (2011.01) |

(52) U.S. Cl.

CPC ..... *H01R 31/06* (2013.01); *H01R 13/6581* (2013.01); *H01R 24/28* (2013.01); *H01R 24/64* (2013.01)

(58) Field of Classification Search

CPC .... H01R 31/06; H01R 13/6581; H01R 24/28; H01R 24/64

USPC ..... 439/607.01, 660, 598, 634, 686, 695, 439/701, 712, 724, 599, 638, 879, 8, 97, 439/607.23, 607.24

See application file for complete search history.

(56) References Cited

U.S. PATENT DOCUMENTS

| | | | | |
|---|---|---|---|---|
| 8,011,968 | B2 * | 9/2011 | Lai | H01R 13/65802 439/660 |
| 8,147,276 | B2 * | 4/2012 | Wang | H01R 12/707 439/660 |
| 8,827,751 | B1 * | 9/2014 | Lan | H01R 13/516 439/607.01 |
| 2013/0178110 | A1 * | 7/2013 | Xie | H01R 4/023 439/660 |
| 2015/0155664 | A1 * | 6/2015 | Lu | H01R 13/506 439/607.24 |

* cited by examiner

*Primary Examiner* — Edwin A. Leon
(74) *Attorney, Agent, or Firm* — Cheng-Ju Chiang

(57) ABSTRACT

An adapter includes an insulating body, a plurality of electrical terminals which are assembled into the insulting body and a shielding shell. The insulating body has a tongue board at a front thereof, the tongue board defines terminal grooves in a bottom surface thereof, a rear surface of the insulating body defines a rear insertion chamber. Each of the electrical terminals has a holding portion assembled in the insulating body, a first contact portion connected with a front end of the holding portion, a second contact portion connected with a rear end of the holding portion. The first contact portions of the electrical terminals are assembled in the terminal grooves and protrude beyond the bottom surface of the tongue board, the second contact portions of the electrical terminals are located in the rear insertion chamber.

6 Claims, 6 Drawing Sheets

ADAPTER AND ELECTRICAL TERMINAL THEREOF

BACKGROUND OF THE INVENTION

1. Field of the Invention

The present invention relates to an adapter, and more particularly to a simple structure, high production efficiency and low cost of adapter and electrical terminal thereof.

2. The Related Art

A data in the car needs to be transferred to a USB (Universal Serial Bus) device by a corresponding adaptor. The existing adapter includes a first connector, a PCB (Printed Circuit Board) and a second connector. One end of the PCB connects with the first connector. The other end of the PCB connects with the second connector.

However, the production cost of the PCB is very high. And the PCB and the two connectors need to be soldered together through the SMT (Surface Mounted Technology), which not only increases the cost of soldering and testing, but also brings difficulty to manufacture. As a result, the production efficiency is reduced.

SUMMARY OF THE INVENTION

An object of the present invention is to provide an adapter. The adapter includes an insulating body, a plurality of electrical terminals which are assembled into the insulating body. The insulating body has a tongue board at a front thereof, the tongue board defines terminal grooves in a bottom surface thereof, a rear surface of the insulating body defines a rear insertion chamber. Each of the electrical terminals has a holding portion assembled in the insulating body, a first contact portion connected with a front end of the holding portion, a second contact portion connected with a rear end of the holding portion. The first contact portions of the electrical terminals are assembled in the terminal grooves and protrude beyond the bottom surface of the tongue board, the second contact portions of the electrical terminals are located in the rear insertion chamber.

Another object of the present invention is to provide an electrical terminal. The electrical terminal includes a holding portion, a first contact portion and a second contact portion. The holding portion has a level base plate, an upward tilted connecting strip connected to a front end of the level base plate, a level fastening plate connected with a front end of the upward tilted connecting strip, and a fastening strip connected with a rear end of the level base plate. The fastening strip has a downward tilted part connected with the rear end of the level base plate and a level part connected with a rear end of the downward tilted part. The first contact portion is connected with a front end of the level fastening plate and arched downward. The second contact portion is connected with a rear end of the level part of the fastening strip.

As described above, the first contact portion is connected with the front end of the holding portion, the second contact portion is connected with the rear end of the holding portion. The first contact portions of the electrical terminals are assembled in the terminal grooves and protrude beyond the bottom surface of the tongue board. The second contact portions of the electrical terminals are located in the rear insertion chamber. Therefore, the adapter of the present invention has simple structure which improves the production efficiency and reduces manufacture cost of the adapter.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
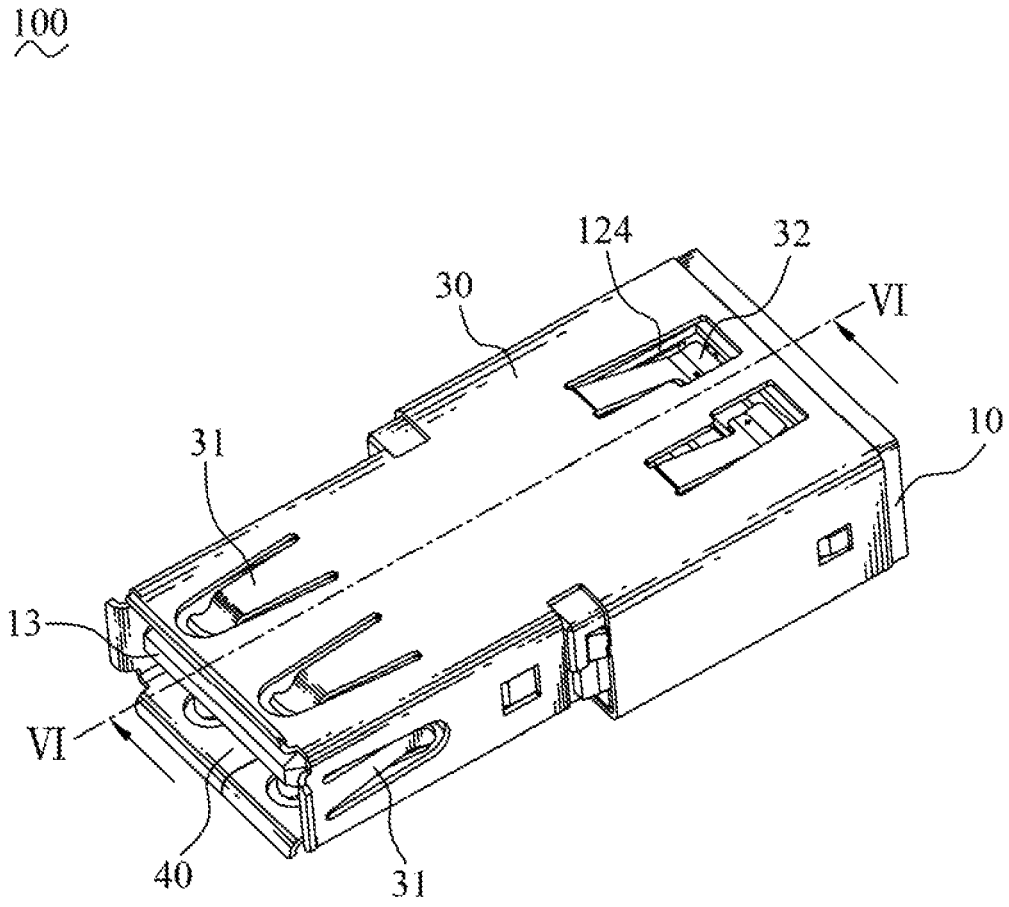
FIG. 1 is an assembled, perspective view of an adapter in accordance with an embodiment of the present invention.
Figure 2:
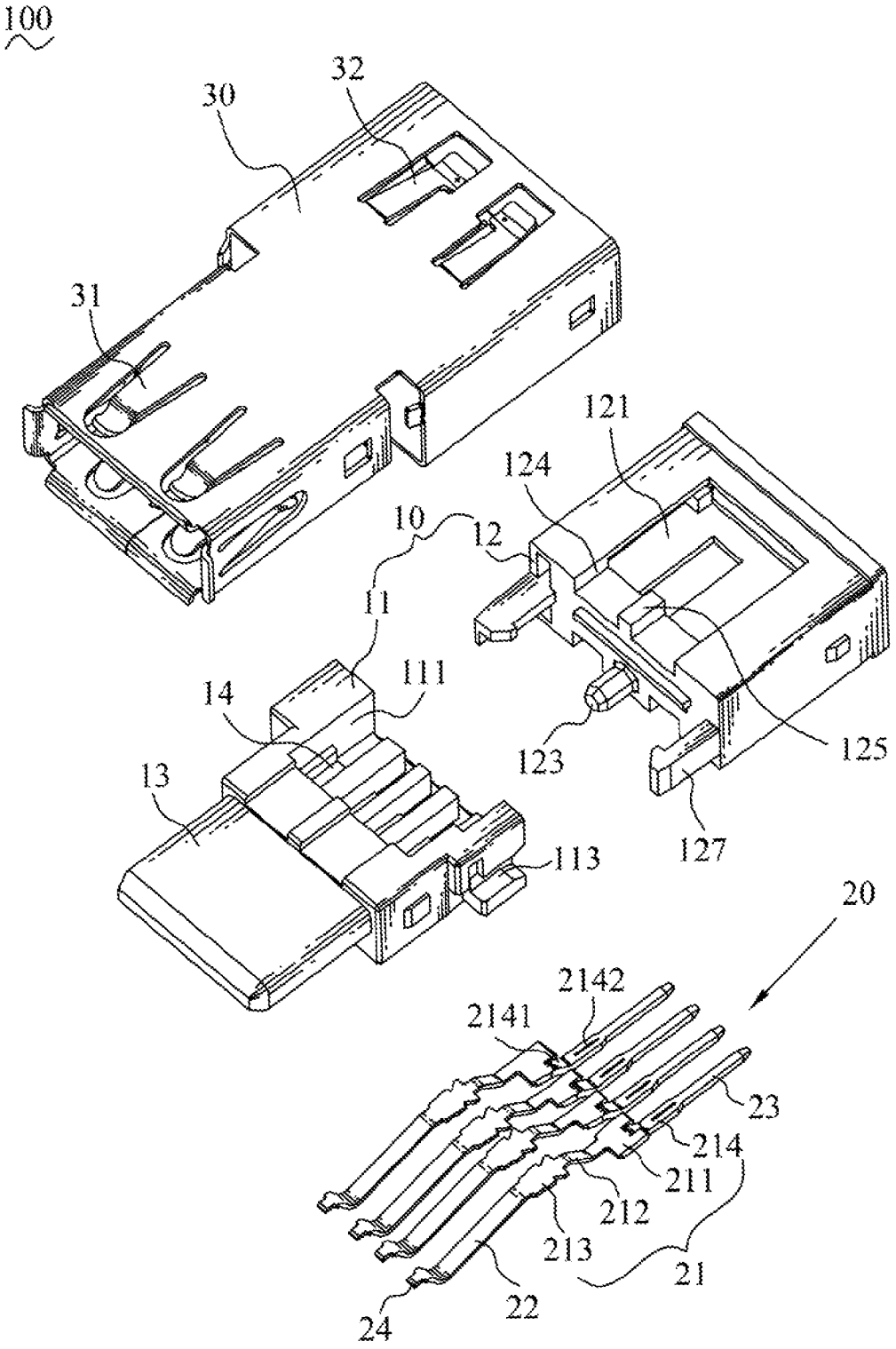
FIG. 2 is an exploded, perspective view of the adapter shown in FIG. 1.
Figure 3:
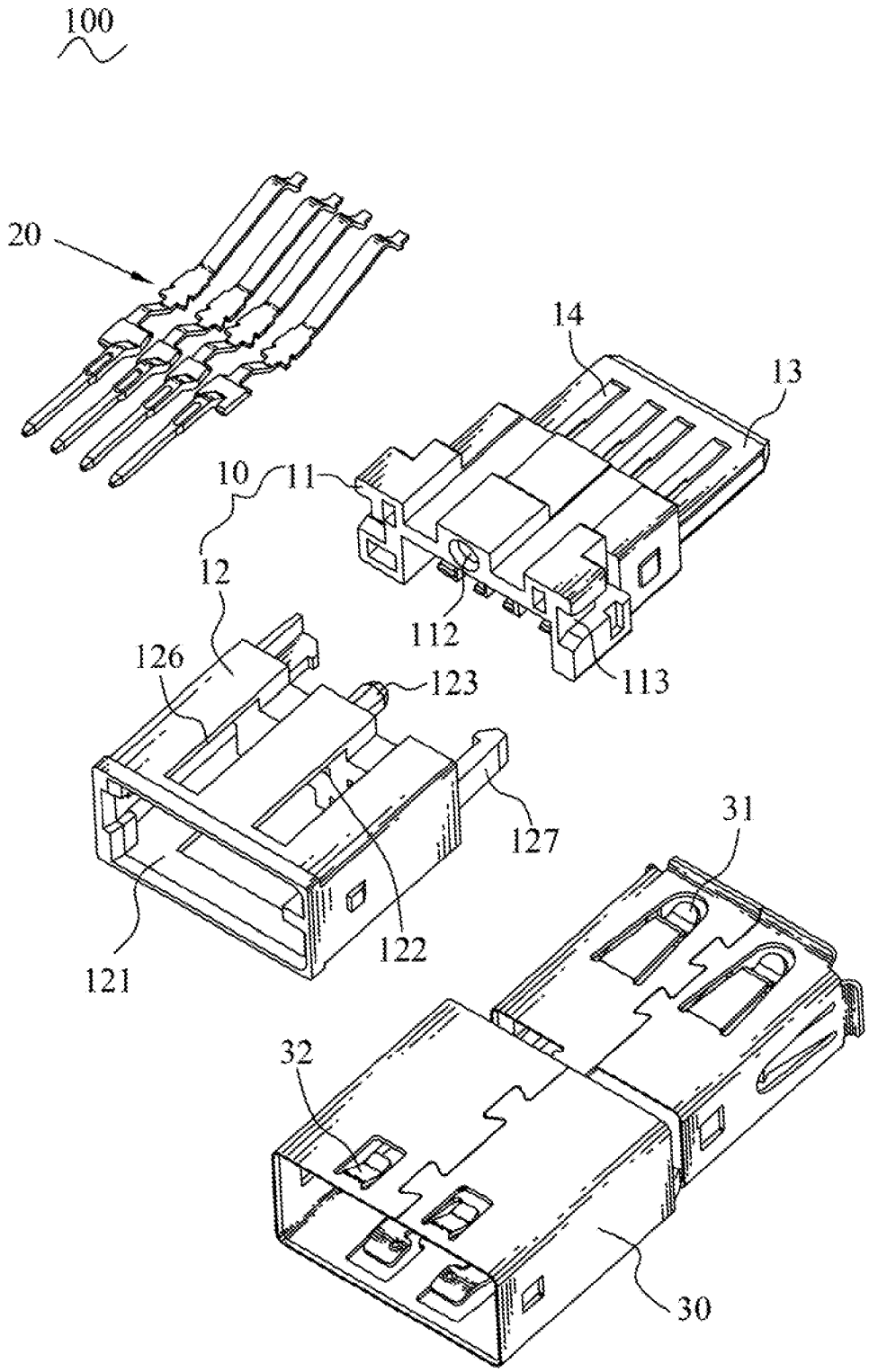
FIG. 3 is another exploded, perspective view of the adapter of FIG. 1 viewed from a different angle.
Figure 4:
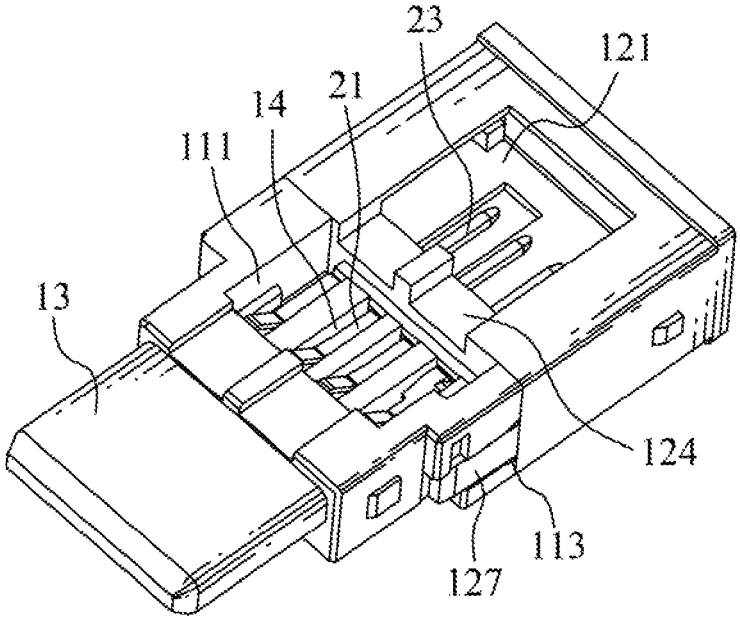
FIG. 4 is an assembled, perspective view of the adapter of FIG. 1, without a shielding shell.
Figure 5:
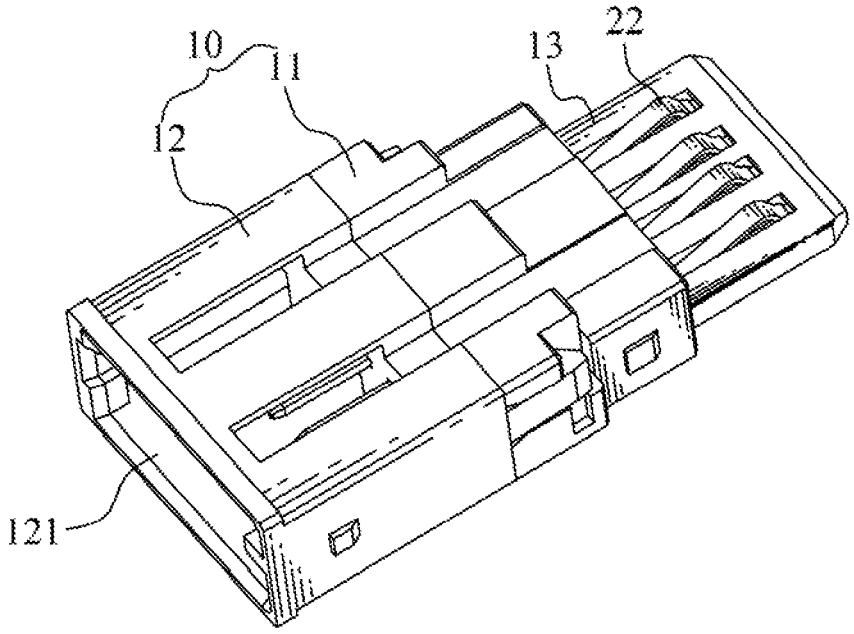
FIG. 5 is another assembled, perspective view of the adapter without the shielding shell shown in FIG. 4.

Referring to FIG. 1, FIG. 2 and FIG. 3, an adapter 100 according to an embodiment of the present invention includes an insulating body 10, a plurality of electrical terminals 20 and a shielding shell 30.

Figure 6:
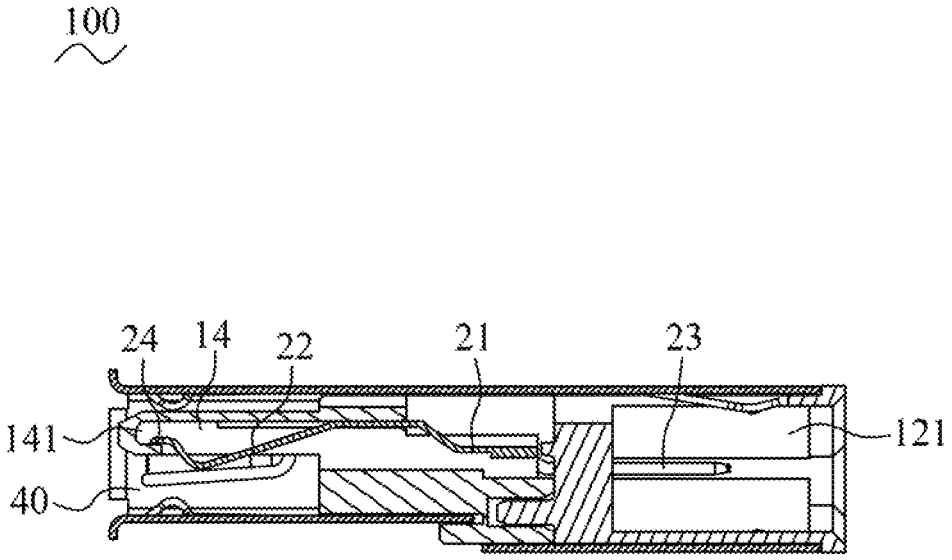
FIG. 6 is a profile view of the adapter along the line VI-VI of FIG. 1.

Referring to FIG. 2, FIG. 3 and FIG. 6, the insulating body 10 have a tongue board 13 at a front thereof. A rear surface of the insulating body 10 defines a rear insertion chamber 121. The insulating body 10 has a first insulating base body 11 and a second insulating base body 12 assembled into a rear end of the first insulating base body 11. An upper portion of a front surface of the first insulating base body 11 protrudes frontward to form the tongue board 13. The tongue board 13 defines a plurality of terminal grooves 14 in a bottom surface thereof, and the terminal grooves 14 are arranged along a transverse direction of the tongue board 13 and extend longitudinally to penetrate a rear surface of the first insulating base body 11. The rear insertion chamber 121 is defined in a rear surface of the second insulating base body 12. An upper portion of a front wall of each of the terminal grooves 14 defines a restricting groove 141 extending forward. A rear portion of a top surface of the first insulating base body 11 defines a cavity 111 communicating with the terminal grooves 14. The rear surface of the first insulating base body 11 defines a holding hole 112. Middles of two sides of the first insulating base body 11 define two locking slots 113 penetrating through the rear surface of the first insulating base body 11.

Referring to FIG. 2, FIG. 3 and FIG. 6, a middle of a front surface of the second insulating base body 12 defines a plurality of fastening holes 122 arranged at intervals along a transverse direction of the second insulating base body 12 and communicated with the rear insertion chamber 121. The front surface of the second insulating base body 12 protrudes frontward to form a fastening pillar 123. A front portion of a top surface of the second insulating base body 12 defines at least one upper groove 124 communicating with the rear insertion chamber 121. A bottom wall of the upper groove 124 protrudes upward to form a protrude block 125. The protrude block 125 and the top surface of the second insulating base body 12 are in the same level. A front portion of a bottom surface of the second insulating base body 12 defines at least one lower groove 126 communicating with the rear insertion chamber 121. Two sides of the front surface of the second insulating base body 12 protrude frontward to form two elastic latch portions 127. The fastening pillar 123 is inserted into the holding hole 112, the elastic latch portions 127 are inserted frontward into the locking slots 113 until the front surface of the second insulating base body 12 resists against the rear surface of the first insulating base body 11.

Referring to FIG. 2, each of the electrical terminals 20 has a holding portion 21, a first contact portion 22 connected with a front end of the holding portion 21, a second contact portion 23 connected with a rear end of the holding portion 21, and a tail portion 24 is connected with a free end of the first contact portion 22. Each of the first contact portions 22 is extended along a frontward and downward direction, and then is curved upward. Each of the second contact portions 23 extends rearward horizontally. Each of the holding portions 21 has a level base plate 211, an upward tilted connecting strip 212 which is connected to a front end of the level base plate 211, a level fastening plate 213 which is connected with a front end of the upward tilted connecting strip 212, and a fastening strip 214 which is connected with a rear end of the level base plate 211. The fastening strip 214 has a downward tilted part 2141 connected with the rear end of the level base plate 211 and a level part 2142 connected with a rear end of the downward tilted part 2141. The first contact portion 22 is connected with a front end of the level fastening plate 213. The second contact portion 23 is connected with a rear end of the level part 2142 of the fastening strip 214.

Referring to FIGS. 2-6, the holding portions 21 are assembled in the insulting body 10. The first contact portions 22 are assembled in the terminal grooves 14, and protrude beyond the bottom surface of the tongue board 13. Specifically, the level base plates 211, the upward tilted connecting strips 212, the level fastening plates 213, and fronts of the fastening strips 214 of the electrical terminals 20 are assembled in rear ends of the terminal grooves 14 of the first insulating base body 11. The first contact portions 22 are assembled in front ends of the terminal grooves 14. Each of the tail portions 24 is received in the restricting groove 141 so as to provide a resistance function from elastic deformation of the first contact portion 22 and prevent the first contact portion 22 from damaging when received in a butting connector (not shown). Each of the level parts 2142 of the fastening strips 214 is located in the fastening hole 122. Each of the second contact portions 23 protrudes rearward out of the front wall of the rear insertion chamber 121, and is located in the rear insertion chamber 121.

Referring to FIG. 1, FIG. 2, FIG. 3 and FIG. 6, the shielding shell 30 is made of a metal plate to show a hollow rectangular cylinder with a front end and a rear end thereof opened, and surrounds the insulating body 10. A front of the shielding shell 30 surrounds the tongue board 13 to form a front insertion chamber 40. Four plates of the front of the shielding shell 30 are stamped inward to form first elastic holding plates 31. A top plate and a bottom plate of a rear of the shielding shell 30 are stamped inward to form four second elastic holding plates 32 stretching into the rear insertion chamber 121.

As described above, the first contact portion 22 is connected with the front end of the holding portion 21, the second contact portion 23 is connected with the rear end of the holding portion 21. The first contact portions 22 of the electrical terminals 20 are assembled in the fronts of the terminal grooves 14 and protrude beyond the bottom surface of the tongue board 13. The second contact portions 23 of the electrical terminals 20 protrude rearward out of the front wall of the rear insertion chamber 121 and are located in the rear insertion chamber 121. Therefore, the adapter 100 of the present invention has simple structure which improves the production efficiency and reduces manufacture cost of the adapter 100.

What is claimed is:

1. An adapter, comprising:

an insulating body, the insulating body having a tongue board at a front thereof, the tongue board defining terminal grooves in a bottom surface thereof, a rear surface of the insulating body defining a rear insertion chamber; and electrical terminals assembled into the insulting body, each of the electrical terminals having a holding portion assembled in the insulating body, a first contact portion connected with a front end of the holding portion, a second contact portion connected with a rear end of the holding portion, the first contact portions of the electrical terminals being assembled in the terminal grooves and protruding beyond the bottom surface of the tongue board, the second contact portions of the electrical terminals being located in the rear insertion chamber;

wherein the holding portion has a level base plate, an upward tilted connecting strip connected to a front end of the level base plate, a level fastening plate connected with a front end of the upward tilted connecting strip, and a fastening strip connected with a rear end of the level base plate, the fastening strip has a downward tilted part connected with the rear end of the level base plate and a level part connected with a rear end of the downward tilted part, the second contact portion is connected with a rear end of the level part of the fastening strip, the first contact portion is connected with a front end of the level fastening plate;

wherein the insulating body has a first insulating base body and a second insulating base body assembled into a rear end of the first insulating base body, the rear insertion chamber is defined in a rear surface of the second insulating base body, an upper portion of a front surface of the first insulating base body protrudes frontward to form the tongue board, the terminal grooves are arranged along a transverse direction of the tongue board and extending longitudinally to penetrate a rear surface of the first insulating base body, the level base plates, the upward tilted connecting strips, the level fastening plates, and fronts of the fastening strips of the electrical terminals are assembled in rear ends of the terminal grooves of the first insulating base body, the first contact portions are assembled in front ends of the terminal grooves.

2. The adapter as claimed in claim 1, wherein a middle of a front surface of the second insulating base body defines a plurality of fastening holes arranged at intervals along a transverse direction of the second insulating base body and communicated with the rear insertion chamber, the level parts of the fastening strips are located in the fastening holes.

3. The adapter as claimed in claim 1, wherein the rear surface of the first insulating base body defines a holding hole, a front surface of the second insulating base body protrudes frontward to form a fastening pillar, the fastening pillar is inserted into the holding hole, the front surface of the second insulating base body resists against the rear surface of the first insulating base body.

4. The adapter as claimed in claim 1, wherein middles of two sides of the first insulating base body define locking slots penetrating through the rear surface of the first insulating base body, two sides of a front surface of the second insulating base body protrudes frontward to form elastic latch portions, the elastic latch portions are inserted frontward into the locking slots.

5. The adapter as claimed in claim 1, wherein an upper portion of a front wall of each of the terminal grooves defines a restricting groove, a tail portion is connected with a free end of the first contact portion, the tail portion is received in the restricting groove.

6. The adapter as claimed in claim 1, further comprising a shielding shell surrounding the insulating body, a front of the shielding shell surrounds the tongue board to form a front insertion chamber.

* * * * *